United States Patent [19]

Leonard

[11] Patent Number: 4,944,049

[45] Date of Patent: Jul. 31, 1990

[54] ADJUSTABLE SHOWER HEAD AND CLOCK APPARATUS

[76] Inventor: Robert Leonard, 7072 Melrose Ave., Apt. A, Buena Park, Calif. 90621

[21] Appl. No.: 319,099

[22] Filed: Mar. 6, 1989

[51] Int. Cl.[5] ..... B05B 1/00

[52] U.S. Cl. ..... 4/597; 4/605; 239/70; 137/624.11

[58] Field of Search ..... 4/596–601, 4/605, 615; 239/70, 280.5, 289; 137/624.11, 624.21; 368/10

[56] References Cited

U.S. PATENT DOCUMENTS

| | | | |
|---|---|---|---|
| 2,121,274 | 6/1938 | Young | 137/624.21 |
| 2,545,928 | 3/1951 | Martin et al. | 239/70 X |
| 2,589,592 | 3/1952 | Ocana | 4/597 X |
| 2,966,311 | 12/1960 | Davis | 4/615 X |
| 3,486,695 | 12/1969 | Novak . | |
| 3,685,745 | 8/1972 | Pescheke-Koedt . | |
| 3,827,013 | 9/1974 | Davis et al. . | |
| 4,189,776 | 2/1979 | Kendall | 364/420 |
| 4,230,155 | 10/1980 | Frye, Sr. et al. | 137/624.22 |
| 4,262,842 | 4/1981 | Grover, Jr. et al. . | |
| 4,282,612 | 8/1981 | King . | |
| 4,345,621 | 8/1982 | Dunckhorst . | |
| 4,351,360 | 9/1982 | Smyth . | |
| 4,421,417 | 12/1983 | McQuade | 368/65 |
| 4,653,534 | 3/1987 | Chung-Shan . | |
| 4,797,820 | 1/1989 | Wilson et al. | 364/510 X |

FOREIGN PATENT DOCUMENTS

| | | | |
|---|---|---|---|
| 1957067 | 5/1971 | Fed. Rep. of Germany | 239/70 |
| 863239 | 3/1941 | France | 137/624.11 |
| 1118372 | 6/1956 | France | 4/596 |

*Primary Examiner*—Henry J. Recla
*Assistant Examiner*—R. M. Fetsuga
*Attorney, Agent, or Firm*—Howard A. Kenyon

[57] ABSTRACT

Disclosed herein is an adjustable shower head apparatus having a digital clock incorporated therein. The shower head can be adjusted upward, downward, forward and backward in addition to the head itself which can be rotated forward and backward. The shower head arms have adjustable friction joints that will provide a fixed position of the shower head when placed anywhere within the boundaries of the shower head movement. A digital clock is mounted in the body of the shower head that can be easily seen by the person taking a shower. In one embodiment, both real time and elapsed time is available from viewing the shower head clock.

19 Claims, 1 Drawing Sheet

ADJUSTABLE SHOWER HEAD AND CLOCK APPARATUS

BACKGROUND OF THE INVENTION

1. Field of the Invention

The present invention relates in general to a movable shower head containing a digital clock and more particularly to a shower head that can be moved up, down, backward and forward in addition to rotating forward and backward. The shower head contains a digital clock that will provide real time and in one embodiment both real time and elapsed time.

2. Description of the Prior Art

A person taking a shower would like to have a multiple of positions that the shower head could be placed to direct a stream of water to any part of the body yet leave the hands free to facilitate the using of soap or shampoo. In addition a person may desire to determine how long the shower has been turned on to conserve water and as information to children who can tell time, the length of time they are staying in the shower.

There have been numerous solutions to the problem of a person staying too long in the shower. For example, U.S. Pat. Nos. 4,653,534, 4,345,621 and 4,262,842 are all directed to timing the amount of water a person uses in a shower. U.S. Pat. No. 4,653,534 and 4,345,621 are mechanical devices controlled by a clock type mechanism for timing having a coil spring, where U.S. Pat. No. 4,262,842 is a complex electronic device that controls only the hot water. This device furnishes audio and visual indications to persons as to how long the hot water has been on. This device also monitors the number of times the hot water has been used during a given period of time such as a month or a year. All of the above patents limit the absolute time a person has the water turned on. If a person is not ready to leave the shower, the shower time must be re-set, usually with some inconvenience such as soap being in the eyes. It is believed that a person would desire to control the time by observing the elapsed time the shower has been on and turn the shower off when through. The embodiment showing elapsed time is for children who may have difficulty remembering the exact time the shower was turned on.

Another patent that provides a timing mechanism is U.S. Pat. No. 3,486,695 which times the amount of a shower water additive. One can also select the type of shower water additive from the various selections available.

Another problem that exists with standard showers is the lack of ability to direct a stream of water to all parts of the body. It is difficult for a tall person to take a shower when the shower head is located for a person of lesser height. Several attempts have been made to provide a mobile shower head. One attempt is U.S. Pat. No. 3,685,745. This shower head can be moved in a semi-circle arc whereby the mechanism keeps the shower head at a constant angle. U.S. Pat. No. 4,282,612 describes a mechanism that is made from a plurality of pipe members connected by universal joints o each end of the pipe member. A handle in the middle allows the shower head which is connected to one of the pipe members to be directed up and down to a limited degree. Another movable shower head described in U.S. Pat. No. 3,837,013 is well known in the art and is a shower head which is connected to the water source by a flexible line. The shower head is detached from the wall and is held by one hand. A slide mechanism allows one to adjust the height of the shower when the shower head is attached to the wall. This shower system has the disadvantage of not having both hands free when directing water to various parts of the body. What is needed is a shower head that is mobile to not only be directed downward on top of a person but to be able to direct water to any part of the body desired while leaving both hands free.

SUMMARY OF THE INVENTION

It is therefore an object of the present invention to provide a mobile shower head.

It is another object of the present invention to provide a shower head to move upward, downward, backward and forward as well as rotating forward and backward.

It is yet another object of the present invention to provide a digital clock in the shower head to provide real time.

It is still another object of the present invention to provide a digital clock in the above shower head to provide both real time and elapsed time.

Briefly, in accordance with the present invention there is provided a shower head supported by at least two longitudinal support members which provide multiple positions of the shower head with respect to the shower wall. The shower head also provides angular position with respect to the shower wall about the point of attachment. A flexible supply member is connected from the shower supply pipe to the shower head. A digital clock is built into the shower head that can provide real time and real time and elapsed time. The clock is easily readable by the person engaged in taking a shower.

The novel features which are believed to be characteristics of the invention as to the system together with further objects and advantages thereof, will be better understood from the following description in connection with the accompanying drawings in which the presently preferred embodiment of the invention is illustrated by way of example. It is to be expressly understood, however, that the drawings are for purposes of illustration and description only, and are not intended as a definition of the limits of the invention.

These and other objects, features and advantages of the present invention will become more readily apparent upon detailed consideration of the following description of a preferred embodiment with reference to the accompanying drawings.

DETAILED DESCRIPTION OF THE PREFERRED EMBODIMENT

Figure 1:
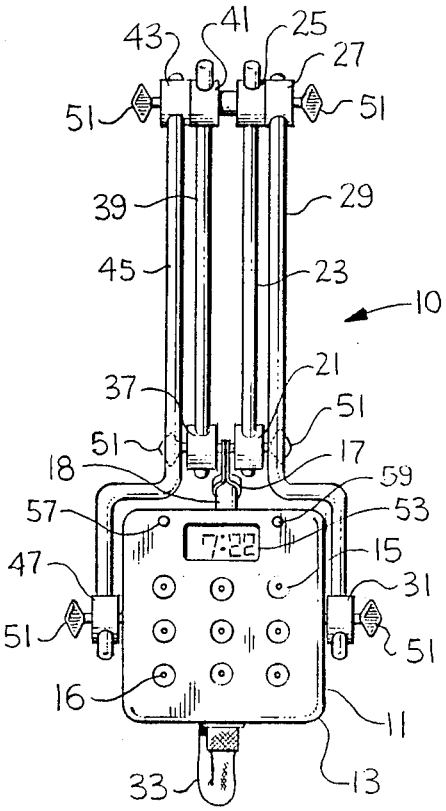
FIG. 1 is a side view of the present invention showing the adjustable arms and the supply hose.

Turning now to FIG. 1 there is generally shown at 10 a view of the adjustable clock shower head. A rectangular shaped shower head housing 11 has rounded edges 13. The housing 11 contains a plurality of nozzles 15. It is understood that the present invention may have from 1 nozzle to as many as practical depending on the spray pattern desired. Nozzles 15 are threadably attached to housing 11 and may be removed for cleaning or the like. The orifice 16 in nozzles 15 are sized to provide a adequate spray to remove soap or shampoo from a person's body. However, orifice 16 may be made smaller or enlarged by replacing nozzles 15 depending on the type of spray and the spray density desired. Since nozzles 15 are threadably attached to housing 11, a restrictor (not shown) may be inserted behind each nozzle 15 to conserve water in case of a water shortage.

Figure 2:
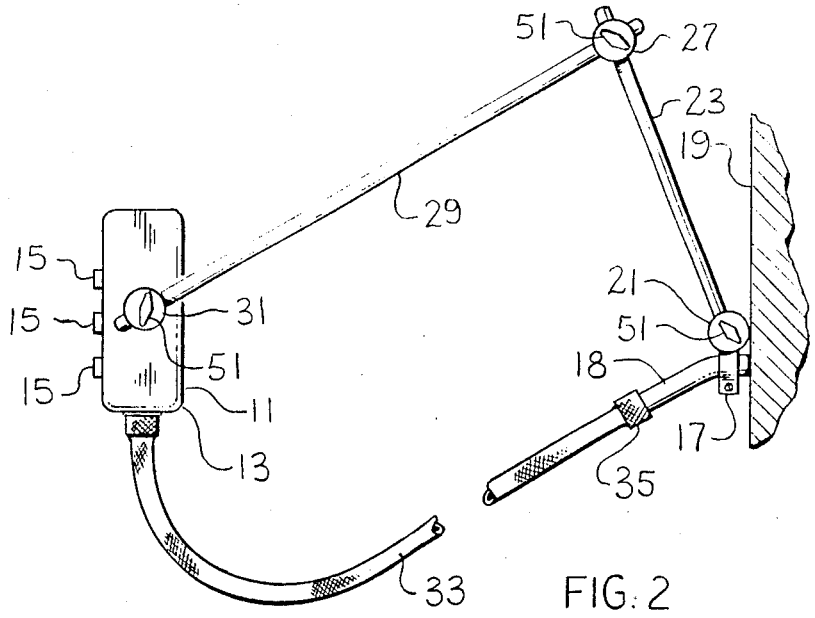
FIG. 2 is a front view of the present invention showing the general configuration of the shower nozzles, the digital clock providing real time and the arm members.

Referring now to FIG. 2 there is seen the right side of the present invention in a slightly extended position. The present invention is attached by a bracket 17 to a standard shower pipe 18 extending from the wall 19. Bracket 17 also supports right frictional pivot 21 which is shown supporting right aft arm 23. Right aft arm 23 is further attached to right frictional pivot 27. Right frictional pivot 27 is attached to right extension forearm 29 which is further attached to right frictional pivot 31. The shower head housing 11 is shown pivotally supported by frictional pivot 31. Nozzles 15 are shown extending slightly outward from housing 11. The supply hose 33 is clearly shown in this view connecting the standard shower pipe 18 to housing 11 by connecting means 35.

Similarly as shown in FIG. 1, bracket 17 also supports left frictional pivot 37 which is shown supporting left aft arm 39. Left aft arm 39 is further attached to left frictional pivot 41. Left frictional pivot 41 is further attached to left frictional pivot 43 which is further attached to left extension arm 45. Left extension forearm 45 is attached to left frictional pivot 47. The shower head housing 11 is shown pivotally supported by frictional pivot 47.

In the present invention the left and right extension forearms, 29 and 45 respectively and left and right aft arms, 23 and 39 respectively, may be of any length so long as they are frictionally supportable by their associated frictional pivots. As is noted on the drawings all pivots have an adjusting screw 51 that can change the amount of friction by turning the screw in or out. This adjustment screw 51 can compensate for the wear that occurs in a frictional pivot with continued use. It is noted that housing 11 may be extended from the wall 19 to a distance equal to the sum of length of the extension forearm 29 and aft arm 23. In addition housing 11 may be rotated to point up or down.

Figure 3:
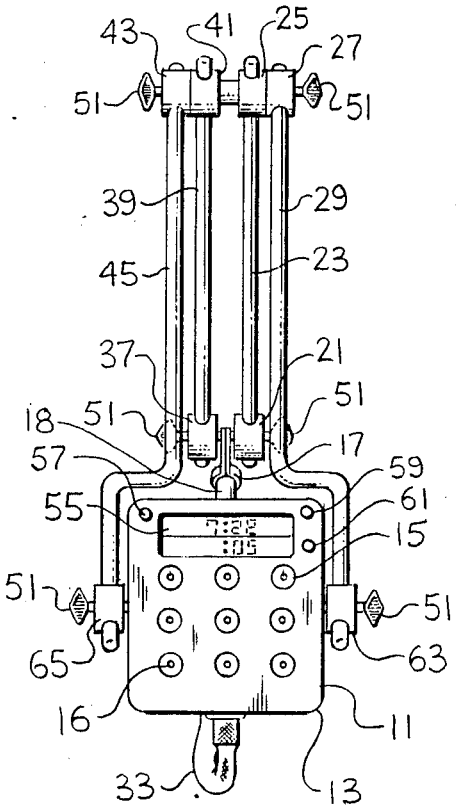
FIG. 3 is the same as FIG. 2 except the digital clock provides both real and elapsed time.

A clock display 53 is mounted in housing 11 that displays only real time as shown in FIG. 1. FIG. 3 shows a clock display 55 that shows real time and elapsed time. In FIG. 1, control switches 57 and 59 control the setting of the hour and the minute respectively in addition to starting and stopping the display. In FIG. 3 a third switch 61 starts and stops the elapsed time which is in minutes. This switch 61 is configured to reset to zero if an additional switch change is made on switch 61 after the elapsed time is stopped. The electronic internal mechanism (not shown) for clocks 53 and 55 may be analog, LED or LCD. The clock display 53 and 55 is mounted in housing 11 and is completely sealed to prevent water contamination. The switches that control the clock mechanism 53 and 55 are also sealed from water contamination. The clock display is mounted to be readily observable by the person taking the shower.

A nine volt battery (not shown) located in shower head housing 11 supplies power for clock display 53 and 55.

Nozzles 15 are all supplied with water through a hose 33 attached to housing 11. The hose 33 is constructed of any flexible material with sufficient strength to withstand the pressure build up across nozzles 15 encountered when the smallest orifice 16 or a restrictor is used.

Housing 11 may be rotated within limits around pivot points 63 and 65 depending on the length of the supply hose. Pivot points 63 and 65 are frictional pivots that can be adjusted by adjusting screw 51.

In operation, the standard shown pipe 18 extending from the wall 19 that supports the adjustable clock shower head apparatus 10 is connected to a riser pipe (not shown) usually inside the wall 19 that further connects to a mixing valve (not shown) which adjusts both pressure and the amount of hot and cold water mix desired. After adjusting the mixing valve, a person may observe the real time or in another embodiment the real time and start the elapsed time. Once a person is thoroughly wetted, the housing 11 may be moved or rotated to allow a person to apply a cleaning substance such a soap, shampoo or the like. After applying a cleaning substance, the housing 11 may be directed to any position to obtain a thorough rinsing operation. One can now enjoy a warm or hot shower to relax the muscles in the body. However, the clock either in real or elapsed time will allow a person to realize how long the shower water is flowing during the relaxing period.

Thus, it is apparent that there has been provided in accordance with the invention, an adjustable shower head apparatus that fully satisfies the objectives, aims, and advantages set forth above. While the invention has been described in conjunction with specific embodiments thereof, it is evident that many alternatives, modifications, and variations will be apparent to those skilled in the art in light of the aforegoing description.

Accordingly, it is intended to embrace all such alternatives, modifications, and variations that fall within the spirit and scope of the appended claims.

What is claimed is:

1. An improved shower apparatus comprising:

support means for supporting said shower apparatus by a threaded connection to a water pipe;

positioning means, attached to said support means, for multiple positioning of said shower apparatus;

nozzle means for providing a liquid flow pattern;

housing means, pivotally attached to said positioning means, for orientationally supporting said nozzle means;

flow means, connected between said support means and said housing means, for facilitating liquid flow from said support means to said housing means; and, an electronic clock mounted in said housing means.

2. The improved shower apparatus of claim 1 wherein said positioning means further comprises:

at least two extension forearms having first ends connected to said housing means and second ends;

at least two aft arms having first ends connected to said second ends of said extension forearms and second ends connected to said support means.

3. The improved shower apparatus of claim 2 wherein the connection between said aft arms and said support means are adjustable frictional connections.

4. The improved shower apparatus of claim 2 wherein the angle of connection between said housing means and said extension forearms, the angle of connection between said extension forearms and said aft arms and the angle of connection between said aft arms and said support means is manually positionable within a preselected set of quantized angles.

5. The improved shower apparatus of claim 2 wherein said nozzle means comprises at least two individual liquid nozzles, said nozzles being threadably attached to said housing means, and said nozzles being removable and replaced with different size orifices to provide a change in flow density.

6. The improved shower apparatus of claim 1 wherein said support means is adapted to accept liquid flow from a water pipe, and wherein said support means forms a flow channel connecting to said flow means.

7. The improved shower apparatus of claim 6 wherein said flow means further comprises a flexible flow channel.

8. The improved shower apparatus of claim 1 wherein said electronic clock display is a digital liquid crystal display.

9. The improved shower apparatus of claim 1 wherein said clock display is in real time in digital form.

10. The improved shower apparatus of claim 1 wherein said electronic clock displays is in real time and elapsed time and is in digital form.

11. An improved shower apparatus comprising:

a plumbing attachment, adapted to be threadably attached to a water pipe;

a pair of aft support members, each having a first end, said first end being attached to said plumbing attachment, and a second end, said aft support member being angularly and adjustably frictionally positionable with respect to said plumbing attachment.

a pair of extension forearm members, each of said forearm member having a first end attached to said second end of it's associated aft support member, and a second end, said extension forearm members angularly and adjustably frictionally positionable with respect to said aft support members;

a housing, adjustably frictionally and pivotally supported by said second ends of said extension forearm members;

a least one flow nozzle threadably attached to said housing; and a supply hose, having a first end connected to said plumbing attachment, and a second end connected to said housing with a liquid channel being formed from said plumbing attachment through said supply hose and through said housing and into at least one of said flow nozzles; and an electric clock mounted in said housing.

12. The improved shower apparatus of claim 11 further comprising an electronic clock within said housing, said electronic clock having a display mounted integrally with said housing.

13. The improved shower apparatus of claim 12 wherein said electronic clock display is a digital liquid crystal display.

14. The improved shower apparatus of claim 12 wherein said electronic clock display is real time in digital form.

15. The improved shower apparatus of claim 12 wherein said electronic clock display is both real time and elapsed time in digital form.

16. The improved shower apparatus as descried in claim 11 wherein said electronic clock is battery operated.

17. The improved shower apparatus as described in claim 11 wherein said housing contains switching means for said electronic clock.

18. The improved shower apparatus as described in claim 1 wherein said electronic clock is battery operated.

19. The improved shower apparatus as described in claim 1 wherein said housing means contains switching means for said electronic clock.

* * * * *